US011346171B2

(12) United States Patent
Yuan et al.

(10) Patent No.: US 11,346,171 B2
(45) Date of Patent: May 31, 2022

(54) DOWNHOLE APPARATUS

(71) Applicant: HALLIBURTON ENERGY SERVICES, INC., Houston, TX (US)

(72) Inventors: Min Mark Yuan, Katy, TX (US); Stephen Allen Yeldell, Golden, CO (US); Lonnie Carl Helms, Humble, TX (US); Frank Vinicio Acosta, Spring, TX (US); Rajesh Parameshwaraiah, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 309 days.

(21) Appl. No.: 16/606,974

(22) PCT Filed: Dec. 5, 2018

(86) PCT No.: PCT/US2018/064051
§ 371 (c)(1),
(2) Date: Oct. 21, 2019

(87) PCT Pub. No.: WO2020/117229
PCT Pub. Date: Jun. 11, 2020

(65) Prior Publication Data

US 2021/0355776 A1 Nov. 18, 2021

(51) Int. Cl.
*E21B 23/04* (2006.01)
*E21B 34/06* (2006.01)

(52) U.S. Cl.
CPC ..... *E21B 23/0413* (2020.05); *E21B 23/0422* (2020.05); *E21B 34/063* (2013.01)

(58) Field of Classification Search
CPC ..... E21B 34/063; E21B 23/0413; E21B 34/14
See application file for complete search history.

(56) References Cited

U.S. PATENT DOCUMENTS 3,463,351 A 8/1969 Mills
3,779,263 A 12/1973 Edwards et al.
3,831,680 A * 8/1974 Edwards ..... E21B 21/10 166/317
3,980,134 A 9/1976 Amancharla
4,457,376 A 7/1984 Carmody et al.
(Continued)

FOREIGN PATENT DOCUMENTS

EP 0566290 A1 10/1993
EP 0681087 B1 9/2000
(Continued)

OTHER PUBLICATIONS

International Search Report and Written Opinion dated Oct. 27, 2020, issued in PCT Application No. PCT/US2020/039399.
(Continued)

*Primary Examiner* — Shane Bomar
(74) *Attorney, Agent, or Firm* — McAfee & Taft

(57) ABSTRACT

A downhole apparatus comprises a casing string with a frangible disk positioned therein. A flow barrier is connected in the casing string and spaced downwardly from the frangible disk. The frangible disk and the flow barrier define a buoyancy chamber. The sliding sleeve will impact and shatter the frangible disk into a plurality of pieces that will pass downwardly in the casing after the casing has been lowered to a desired depth.

17 Claims, 3 Drawing Sheets

(56) References Cited

U.S. PATENT DOCUMENTS

| | | | | |
|---|---|---|---|---|
| 5,150,756 | A | 9/1992 | Hassanzadeh | |
| 5,479,986 | A | 1/1996 | Gano et al. | |
| 5,765,641 | A | 6/1998 | Shy et al. | |
| 5,826,661 | A | 10/1998 | Parker et al. | |
| 6,026,903 | A | 2/2000 | Shy et al. | |
| 6,076,600 | A | 6/2000 | Vick, Jr. et al. | |
| 6,161,622 | A | 12/2000 | Robb et al. | |
| 6,324,904 | B1 | 12/2001 | Ishikawa et al. | |
| 6,450,263 | B1 | 9/2002 | Schwendemann | |
| 6,505,685 | B1 | 1/2003 | Sullaway et al. | |
| 6,622,798 | B1 | 9/2003 | Rogers et al. | |
| 6,651,748 | B2 | 11/2003 | Sullaway et al. | |
| 6,672,389 | B1 | 1/2004 | Hinrichs | |
| 6,758,281 | B2 | 7/2004 | Sullaway et al. | |
| RE39,209 | E * | 8/2006 | Barton | E21B 33/1295 166/317 |
| 7,270,191 | B2 | 9/2007 | Drummond et al. | |
| 7,533,727 | B2 * | 5/2009 | Barton | E21B 34/063 137/68.21 |
| 8,505,621 | B2 | 8/2013 | Telfer et al. | |
| 8,579,027 | B2 | 11/2013 | Abdelmalek et al. | |
| 9,033,055 | B2 | 5/2015 | Mccoy et al. | |
| 9,309,752 | B2 | 4/2016 | Talley et al. | |
| 9,441,437 | B2 | 9/2016 | Fripp et al. | |
| 9,441,446 | B2 | 9/2016 | Fripp et al. | |
| 9,518,445 | B2 | 12/2016 | Noske | |
| 9,540,904 | B2 | 1/2017 | Petrowsky | |
| 9,593,542 | B2 | 3/2017 | Getzlaf et al. | |
| 10,107,070 | B2 * | 10/2018 | Yong | H04L 41/0266 |
| 10,138,707 | B2 | 11/2018 | Tolman et al. | |
| 10,323,478 | B2 | 6/2019 | Berscheidt et al. | |
| 10,655,413 | B2 * | 5/2020 | Brandsdal | E21B 33/1208 |
| 2002/0185273 | A1 | 12/2002 | Aronstam et al. | |
| 2003/0116324 | A1 | 6/2003 | Dawson et al. | |
| 2003/0217844 | A1 | 11/2003 | Moyes | |
| 2008/0029273 | A1 | 2/2008 | Pia | |
| 2008/0073075 | A1 | 3/2008 | Buyers et al. | |
| 2008/0115942 | A1 | 5/2008 | Keller et al. | |
| 2010/0270031 | A1 | 10/2010 | Patel | |
| 2010/0294376 | A1 | 11/2010 | O'Brien et al. | |
| 2011/0042099 | A1 | 2/2011 | Williamson, Jr. et al. | |
| 2011/0253392 | A1 | 10/2011 | May et al. | |
| 2012/0111566 | A1 | 5/2012 | Sherman et al. | |
| 2014/0174757 | A1 | 6/2014 | Fripp et al. | |
| 2014/0216756 | A1 | 8/2014 | Getzlaf et al. | |
| 2014/0224505 | A1 | 8/2014 | Ramon | |
| 2014/0338923 | A1 | 11/2014 | Fripp et al. | |
| 2015/0107843 | A1 | 4/2015 | Talley et al. | |
| 2015/0129205 | A1 | 5/2015 | Hofman et al. | |
| 2015/0240596 | A1 | 8/2015 | Horwell | |
| 2015/0315873 | A1 * | 11/2015 | Mailand | E21B 34/108 166/307 |
| 2016/0177668 | A1 | 6/2016 | Watson et al. | |
| 2016/0333658 | A1 | 11/2016 | Keshishian et al. | |
| 2017/0096875 | A1 | 4/2017 | Ravensbergen et al. | |
| 2017/0138153 | A1 | 5/2017 | Getzlaf et al. | |
| 2018/0003004 | A1 | 1/2018 | Norman et al. | |
| 2018/0058179 | A1 | 3/2018 | Nuryaningsih et al. | |
| 2018/0080308 | A1 | 3/2018 | Dedman et al. | |
| 2018/0156002 | A1 * | 6/2018 | Brandsdal | E21B 29/00 |
| 2018/0219200 | A1 | 8/2018 | Albukrek et al. | |
| 2018/0262127 | A1 | 9/2018 | Gooneratne et al. | |
| 2018/0371869 | A1 | 12/2018 | Kellner et al. | |
| 2019/0128081 | A1 | 5/2019 | Ross et al. | |
| 2019/0352994 | A1 | 11/2019 | Giroux | |
| 2019/0352995 | A1 | 11/2019 | Giroux et al. | |
| 2020/0190940 | A1 * | 6/2020 | Saraya | E21B 34/063 |
| 2021/0131221 | A1 * | 5/2021 | Helms | E21B 17/01 |
| 2021/0230970 | A1 * | 7/2021 | Yuan | E21B 41/00 |
| 2021/0254430 | A1 * | 8/2021 | Yuan | E21B 33/12 |
| 2021/0363858 | A1 * | 11/2021 | Yuan | E21B 34/06 |
| 2021/0372223 | A1 * | 12/2021 | Helms | E21B 33/12 |

FOREIGN PATENT DOCUMENTS

| | | | |
|---|---|---|---|
| JP | 6551001 | B2 | 7/2019 |
| WO | 2014098903 | A1 | 6/2014 |
| WO | 2015073001 | A1 | 5/2015 |
| WO | 2016176643 | A1 | 11/2016 |
| WO | 2019099046 | A1 | 5/2019 |

OTHER PUBLICATIONS

International Search Report and Written Opinion dated Feb. 24, 2021, issued in PCT Application No. PCT/US2020/040157.
International Search Report and Written Opinion dated Aug. 14, 2018, issued in PCT Application No. PCT/US2017/062528.
International Search Report and Written Opinion dated Sep. 19, 2019, issued in PCT Application No. PCT/US2018/066889.
International Search Report and Written Opinion dated Sep. 19, 2019, issued in PCT Application No. PCT/US2018/067161.
International Search Report and Written Opinion dated Jan. 14, 2020, issued in PCT Application No. PCT/US2019/027502.
International Search Report and Written Opinion dated Feb. 5, 2020, issued in PCT Application No. PCT/US2019/031541.
International Search Report and Written Opinion dated Jan. 16, 2020, issued in PCT Application No. PCT/US2019/027625.
International Search Report and Written Opinion dated Jan. 21, 2020, issued in PCT Application No. PCT/US2019/028508.
International Search Report and Written Opinion dated May 25, 2020, issued in PCT Application No. PCT/US2019/056206.
International Search Report and Written Opinion dated May 26, 2020, issued in PCT Application No. PCT/US2019/059757.
International Search Report and Written Opinion dated Jul. 21, 2020, issued in PCT Application No. PCT/US2019/059864.
International Search Report and Written Opinion dated Jul. 23, 2020, issued in PCT Application No. PCT/US2019/061714.
International Search Report and Written Opinion dated Aug. 11, 2020, issued in PCT Application No. PCT/US2019/065862.
International Search Report and Written Opinion dated Aug. 31, 2020, issued in PCT Application No. PCT/US2020/012307.
International Search Report and Written Opinion dated Aug. 14, 2019, issued in corresponding PCT Application No. PCT/US2018/064051.

* cited by examiner

DOWNHOLE APPARATUS

The length of deviated or horizontal sections in well bores is such that it is sometimes difficult to run well casing to the desired depth due to high casing drag. Long lengths of casing create significant friction and thus problems in getting casing to the toe of the well bore. Creating a buoyant chamber in the casing utilizing air or a fluid lighter than the well bore fluid can reduce the drag making it easier to overcome the friction and run the casing to the desired final depth.

BRIEF DESCRIPTION OF THE DRAWINGS

FIG. 2 is a cross section of a buoyancy assist tool of the current disclosure.

FIG. 3 is a cross section of the buoyancy assist tool of FIG. 2 in a second position.

DESCRIPTION

Figure 1:
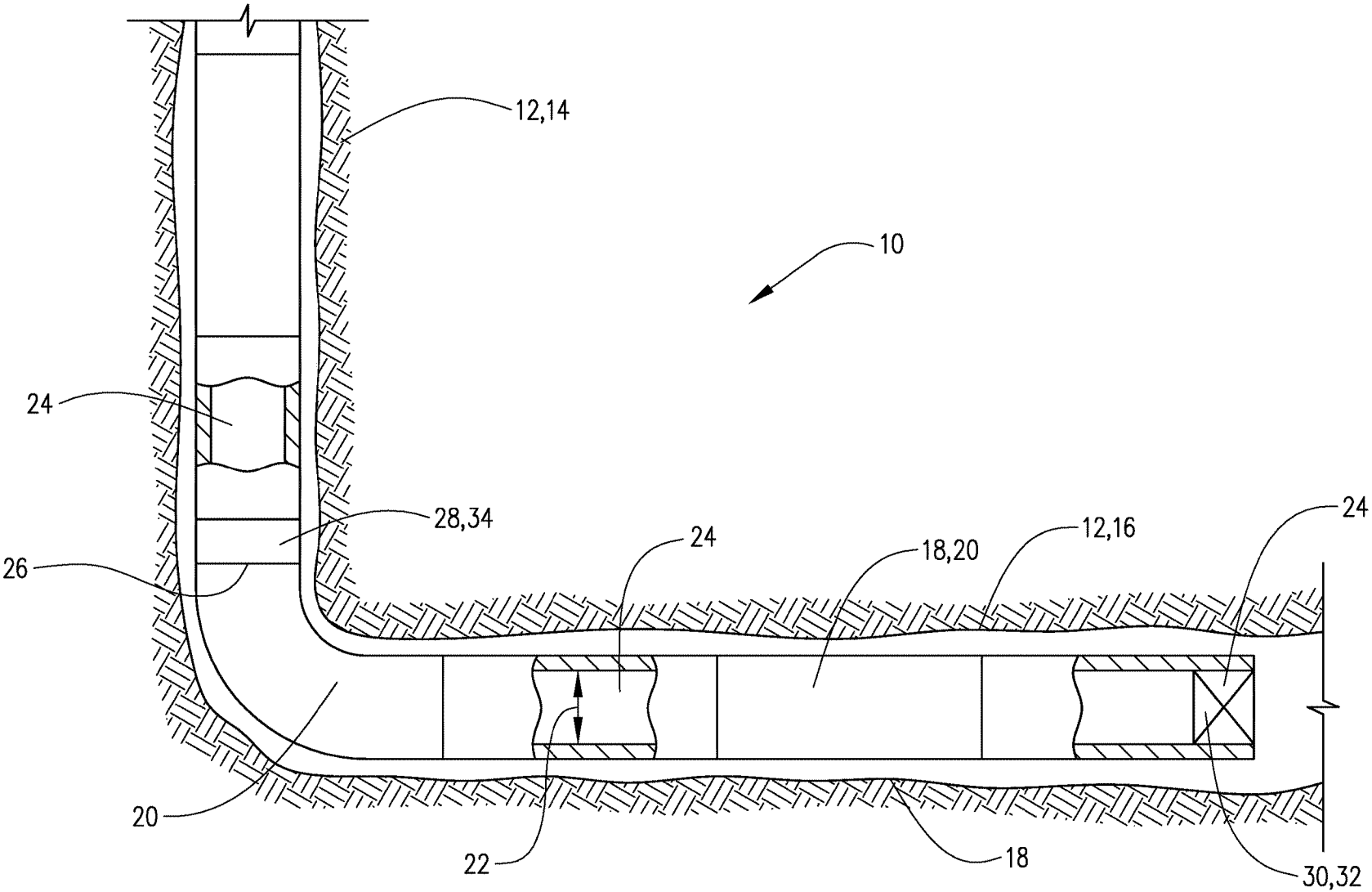
FIG. 1 is a schematic cross section view of an exemplary well bore with a well casing including a buoyancy chamber therein.

The following description and directional terms such as above, below, upper, lower, uphole, downhole, etc., are used for convenience in referring to the accompanying drawings. One who is skilled in the art will recognize that such directional language refers to locations in the well, either closer or farther from the wellhead and the various embodiments of the inventions described and disclosed here may be utilized in various orientations such as inclined, deviated, horizontal and vertical.

Referring to the drawings, a downhole apparatus 10 is positioned in a well bore 12. Well bore 12 includes a vertical portion 14 and a deviated or horizontal portion 16. Apparatus 10 comprises a casing string 18 which is made up of a plurality of casing joints 20. Casing joints 20 may have inner diameter or bore 22 which defines a central flow path 24 therethrough. Well casing 18 defines a buoyancy chamber 26 with upper end or boundary 28 and lower end or boundary 30. Buoyancy chamber 26 will be filled with a buoyant fluid which may be a gas such as nitrogen, carbon dioxide, or air but other gases may also be suitable. The buoyant fluid may also be a liquid such as water or diesel fuel or other like liquid. The important aspect is that the buoyant fluid has a lower specific gravity than the well fluid in the well bore 12 in which casing 18 is run. The choice of gas or liquid, and which one of these are used is a factor of the well conditions and the amount of buoyancy desired.

Lower boundary 30 may comprise a float device such as a float shoe or float collar. As is known, such float devices will generally allow fluid flow downwardly therethrough but will prevent flow upwardly into the casing. The float devices are generally a one way check valve. The float device 30 will be configured such that it will hold the buoyant fluid in the buoyancy chamber 26 until additional pressure is applied after the release of the buoyancy fluid from the buoyancy chamber.

The upper boundary 28 is defined by a buoyancy assist tool 34. Buoyancy assist tool 34 comprises an outer case 36 with upper and lower ends 38 and 40 connected to casing joints 20 thereabove and therebelow. Thus, outer case 36 defines a portion of casing string 18. Outer case 36 has an inner surface 42 defining a bore 43 therethrough. An upward facing shoulder 44 is defined in bore 43 by a first inner diameter 45 and a second smaller diameter 46 on inner surface 42 of case 36. Outer case 34 may comprise an upper portion 50 with lower portion 52 threadedly connected thereto.

Buoyancy assist tool 34 includes a sliding sleeve 48 which may be referred to as a sliding hammer sleeve 48. Sliding hammer sleeve 48 is movable in outer case 36 in the first position as shown in FIG. 2 to a second position as shown in FIG. 3. Sliding hammer sleeve 48 has inner surface 51 and upper and lower ends 54 and 56 respectively. Lower end 56 is a sloped or slanted lower end that terminates in an impact point 58. Impact point 58 is a sharp point which effectively acts as a hammer to shatter a frangible disk as will be described in more detail. Inner surface 51 defines an open or unobstructed bore 60 with a diameter 62. Diameter 62 may be the smallest bore through the casing string 18 and may be for example essentially the same as inner diameter 22 of casing string 18. Bore 60 is thus an open unobstructed bore such that well tools can pass therethrough to portions of the casing string 18 therebelow for use in well bore 12. In other words, buoyancy tool 34 may be configured so that it does not provide a size restriction on tools that can pass therethrough that does not already exist based on the inner diameter of the casing to which it is attached.

Sliding hammer sleeve 48 has an outer surface 64. An annular air chamber 66 is defined by and between sliding hammer sleeve 48 and outer case 36, and specifically between outer surface 64 of sliding hammer sleeve 48 and inner surface 42 of outer case 36. Annular air chamber 66 has an upper terminus or an upper end 68 and lower terminus or lower end 70. Lower end 70 is at shoulder 44 defined on the inner surface of outer case 36. The upper end in the embodiment described is at the lower end of upper portion 50 of outer case 36. Sliding hammer sleeve 48 sealingly engages casing 15 above and below air chamber 66 in the first position shown in FIG. 2. A seal 74 received in a groove 75 may sealingly engage casing string 18 above annular air chamber 66 and a seal 76 may engage casing string 18 below annular air chamber 66. In the embodiment shown the seal 74 is sealingly engaged with the inner surface 42 of outer case 36 on upper portion 50 and seal 76 will sealingly engage inner surface 42 of outer case 36 on lower portion 52.

An outer ring, which may be referred to as a piston ring 80 extends radially outwardly from outer surface 64 of sliding hammer sleeve 48. Piston ring 80 extends outwardly from outer surface 64 and sealingly engages outer case 36. Specifically, piston ring 80 sealingly engages the inner surface 42 of outer case 36. A seal 84 may be placed in a groove 82 in piston ring 80 to sealingly engage against outer case 36. Piston ring 80 may be integrally formed or machined as part of sliding hammer sleeve 48 or may be a separate piece fixedly connected thereto in the manner known in the art.

A frangible or breakable disk 86 is mounted in a groove 88 in casing string 18 and in the embodiment described is mounted in a groove 88 in outer case 34. A snap ring 90 may be positioned below groove 88 and may hold frangible disk 86 in place. Breakable disk 86 is the upper end of buoyancy chamber 26 and will hold the buoyancy fluid therein. A rupture disk 100 is located in a port 102 in a wall of sliding hammer sleeve 48. The port 102 is communicated with annular air chamber 66 above piston ring 80. Thus, when rupture disk 100 is ruptured fluid flowing through casing string 18 thereabove will pass through port 102 and into air chamber 66. The fluid will push sliding hammer sleeve 48 rapidly downward to break the frangible disk 86 into a plurality of pieces. Preferably the breakable disk is tempered glass or ceramic or other material that will shatter into a number of pieces that will then flow downwardly through the casing string 18. The frangible disk 86 breaks as the sliding hammer sleeve 48 is moving from its first position shown in FIG. 2 to the second position shown in FIG. 3. In the second position sliding hammer sleeve 48 will cover groove 88. As a result, any jagged edges that might remain after disk 86 is shattered will be scraped away from the inner surface 42 of outer case 36 and will likewise pass downwardly through casing string 18. Hammer sleeve 48 is pressure balanced in the first position shown in FIG. 2.

In operation casing string 18 is lowered into wellbore 12 to a desired location. Running a casing such as casing 18 in deviated wells and long horizontal wells often results in significantly increased drag forces and may cause a casing string to become stuck before reaching the desired location in the wellbore. For example, when the casing produces more drag forces than the available weight to slide the casing down the well, the casing may become stuck. If too much force is applied to the casing string 18 damage may occur. The buoyancy assist tool 34 as described herein alleviates some of the issues and at the same time provides for a full bore passageway so that other tools or objects such as, for example production packers, perforating guns and service tools may pass therethrough without obstruction after well casing 18 has reached the desired depth. When well casing 18 is lowered into wellbore 12 buoyancy chamber 26 will aid in the proper placement since it will reduce friction as the casing 18 is lowered into horizontal portion 16 to the desired location.

Once the final depth is reached in wellbore 12, fluid pressure in well casing 18 can be increased to a predetermined pressure at which the rupture disk 100 will burst. After the rupture disk 100 bursts a flow passage is created to annular air chamber 66. Fluid will pass through port 102 into the air chamber 66 and will act upon piston ring 80. The pressure applied thereto by the fluid will rapidly slide hammer sleeve downwardly so that the lower end 56 thereof, and specifically the hammer point 58 will impact frangible disk 86. The result will be that disk 86 will shatter into a plurality of pieces which will fall through the casing string 18. Sliding hammer sleeve 48 will pass downwardly into the second position ensuring that any jagged edges or pieces that remain in or around groove 88 are also removed and passed down through casing 18. In second position of the buoyancy assist tool 34 piston ring 80 will rest on shoulder 44. When the frangible disk 86 breaks buoyancy fluid will be released.

Because disk 86 is shattered completely and there are no remnants thereof a smooth unobstructed bore is provided through casing 18 and specifically through sliding hammer sleeve 48 such that other devices such as service tools, perforating guns and production packers may pass therethrough. As described above, the buoyancy assist tool 34 may be configured such that it does not restrict the size of tools that can pass through the casing string beyond the restriction that exists as a result of the joints of the casing string itself. It is understood the list of tools and equipment provided herein is exemplary and is no way limiting.

Figure 4:
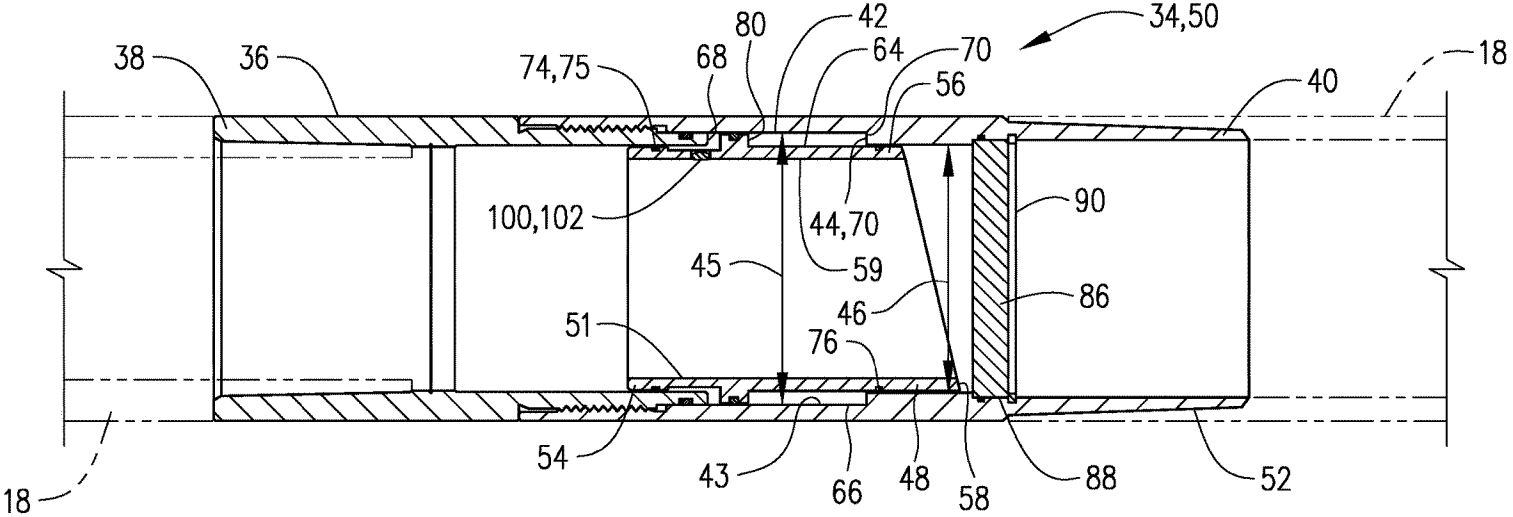
FIG. 4 is an alternative embodiment of a buoyancy assist tool in the first position.
Figure 5:
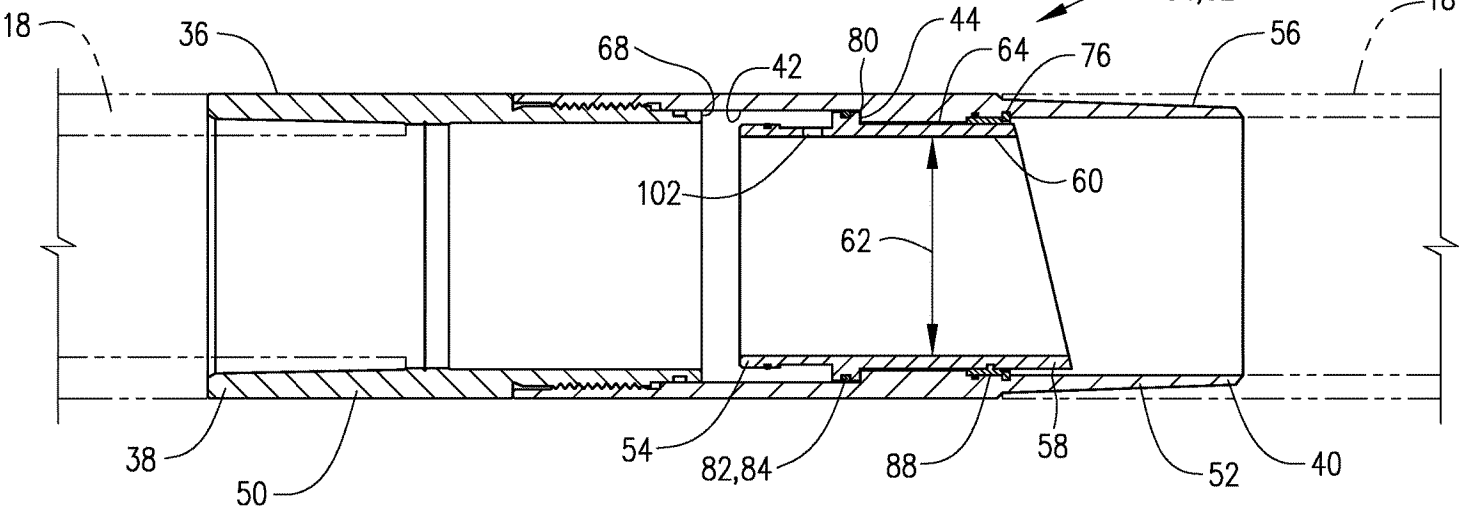
FIG. 5 is the embodiment of FIG. 4 in the second position.
Figure 4:
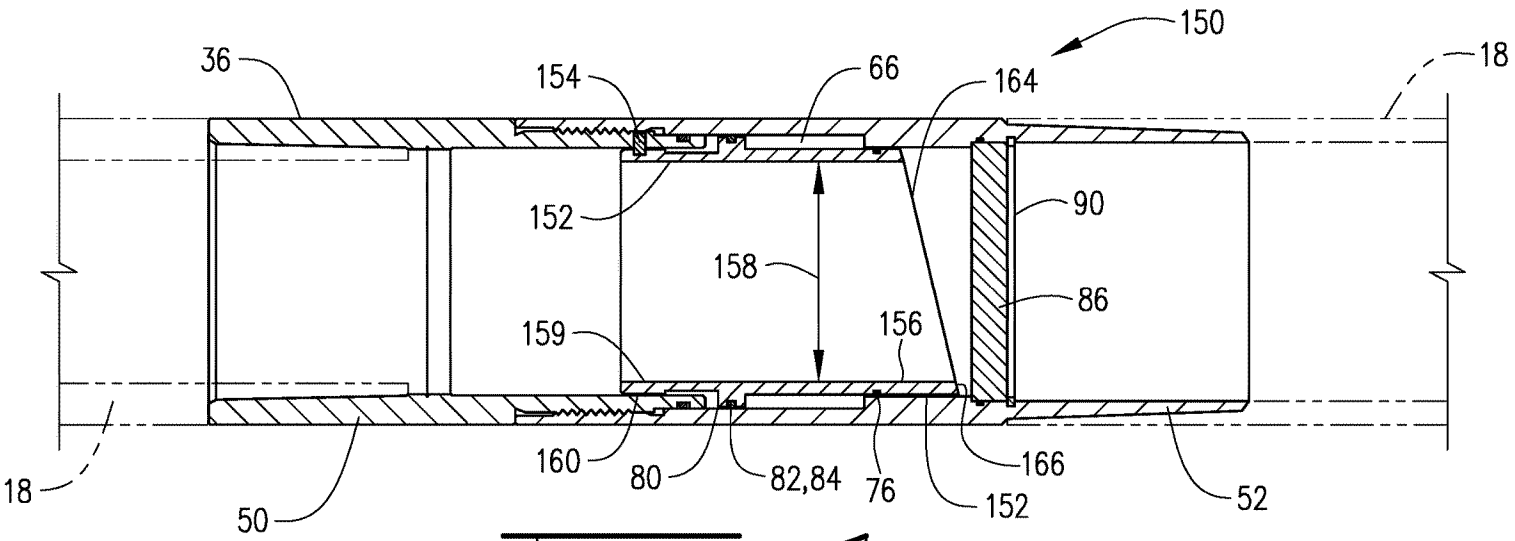
Figure 5:
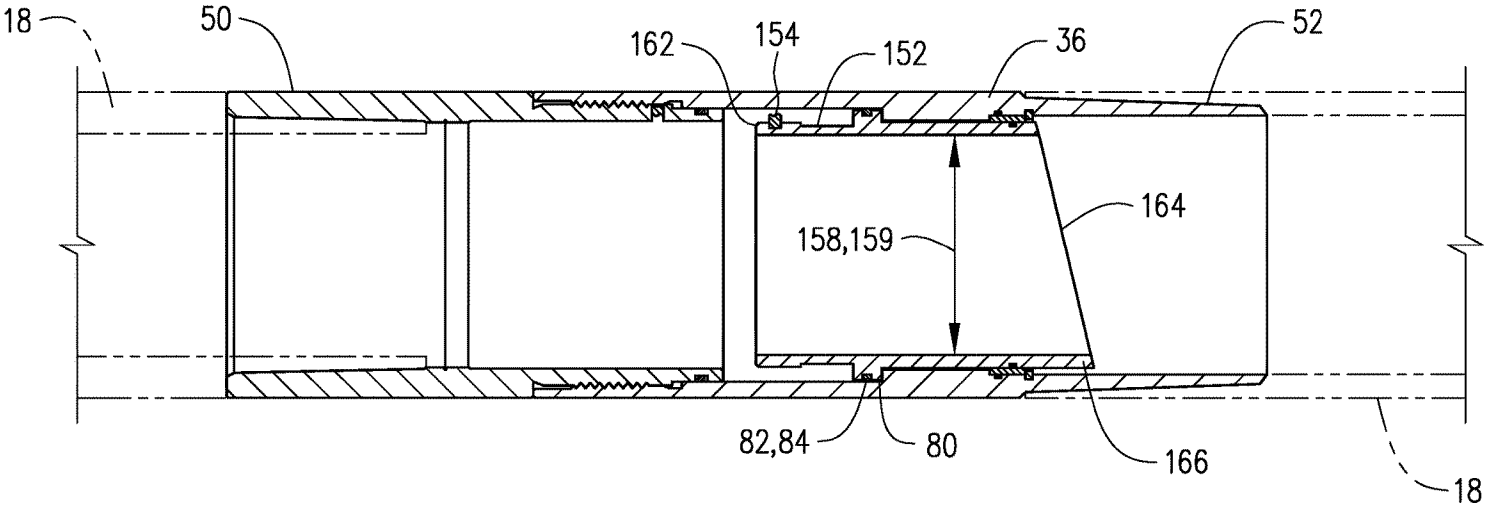

An additional embodiment of a buoyancy assist tool is shown in FIGS. 4 and 5. The embodiment shown therein is generally identical to that described with respect to the embodiment shown in FIG. 2 except for the manner in which the sliding hammer sleeve is held in place and the passage for communicating fluid to the annular air chamber. The buoyancy assist tool shown in FIGS. 4 and 5 will be referred to as buoyancy assist tool 150. The primary distinction between buoyancy assist tool 150 and buoyancy assist tool 34 is the sliding sleeve configuration, the way in which the sliding sleeve is held in its first position and the manner of moving the sliding sleeve to the second position.

Buoyancy assist tool 150 comprises outer case 36 with a sliding hammer sleeve 152 positioned therein. A shear pin 154 attaches sliding sleeve 152 to casing string 18 and specifically connects to the upper portion 50 of outer case 36. Sliding hammer sleeve 152 has inner surface 156 defining a bore 159 with diameter 158. A fluid passage 160 is defined by and between sliding hammer sleeve 150 and upper case 36, specifically upper portion 50 of upper case 36. Passage 160, which may be an annular fluid passage 160, will communicate fluid from central flow passage 24 into annular air chamber 66. Seal 76 will sealingly engage casing 18 and specifically an inner surface 36 of outer case 34 below air chamber 66 in the first position of the buoyancy assist tool 50. Sliding hammer sleeve 150 has upper end 162 and lower end 164 terminating in a sharp point 166. Point 166 may be referred to as an impact, or hammer point.

The manner of operation of the embodiment of FIG. 4 is apparent from the FIGURES. Fluid pressure in casing 18 above buoyancy assist tool 150 will be increased and the pressure will be applied to piston ring 80. Shear pin 154 will have a pre-determined strength such that at a pre-determined pressure in the casing string 18 the shear pin will break to allow sliding hammer sleeve 152 to move rapidly downward. Sliding hammer sleeve 152, and more specifically the impact point 166, will move from the first to the second position and will impact disk 86. Sliding hammer sleeve 152 will impact disk 86 and disk 86 will shatter and the plurality of pieces of shattered disk 86 will pass downwardly in casing string 18. Any jagged edges or debris that remain in groove 88 will be scraped away and will fall downward through casing 18 when sliding hammer sleeve 150 moves from the first to the second position. Thus, in the embodiment of FIGS. 4 and 5 just as in the embodiment of FIG. 2, flow through the well casing 18 is reestablished and well tools as described herein can pass through the unobstructed bore of buoyancy assist tool 150 to locations in the casing string 18 therebelow.

A downhole apparatus comprises a casing string with a frangible disk positioned therein. A flow barrier is connected in the casing string and spaced downwardly from the frangible disk. The frangible disk and the flow barrier define a buoyancy chamber. In one embodiment, a sliding sleeve is spaced from the frangible disk and is movable from a first to a second position in the casing. The sliding sleeve will impact and shatter the frangible disk into a plurality of pieces that will pass downwardly in the casing.

Thus, as described herein, the sliding sleeve impacts and shatters the frangible disk prior to reaching the second position. The sliding sleeve and an inner surface of the well casing define an air chamber therebetween. In one embodiment a piston ring extends radially outwardly from an outer surface of the sliding sleeve into the air chamber and sealingly engages the inner surface of the casing. The frangible disk is mounted in a groove defined in the casing, and the sliding sleeve covers the groove in the second position.

In an additional embodiment a fluid passage is communicated with the air chamber defined between the sliding sleeve and the casing string. Fluid passing through the fluid passage will move the piston ring and the sliding sleeve into the second position. In another embodiment a rupture disk is positioned in a port in a wall of the sliding sleeve, and the port communicates fluid to the air chamber when a burst pressure is applied to the rupture disk to move the sliding sleeve to the second position.

In one embodiment a downhole apparatus comprises a casing string with first and second spaced-apart flow barriers defining a buoyancy chamber therein. A sliding sleeve having upper and lower ends is disposed in the casing string, and the lower end comprises a slanted lower end terminating in a sharp end. The sliding sleeve is movable from first to second positions in the casing. The first flow barrier comprises a frangible barrier. In an embodiment the lower end of the sliding sleeve shatters the first flow barrier into a plurality of fragments when the sliding sleeve moves from the first to the second position in the well casing. The inner diameter of the sliding sleeve may be such that it will not restrict the size of well tools that can pass therethrough beyond the restriction that exists as a result of the casing size.

A rupture disk is positioned in a port in a wall of the sliding sleeve, and the sliding sleeve and the casing defining an annular air chamber therebetween. The port communicates fluid from a central flow passage of the casing into the annular air chamber when the rupture disk ruptures, and the fluid entering the air chamber moves the sliding sleeve from the first to the second position. A piston ring fixedly disposed about the sliding sleeve extends into the air chamber, and fluid communicated through the port moves the piston ring in the air chamber.

In one embodiment a connector releasably connects the sliding sleeve to the casing string. A piston ring is connected to and extends radially outwardly from the sliding sleeve into an air chamber defined by the sliding sleeve and the casing. The piston ring may be integrally formed or machined as part of the sliding sleeve. The downhole apparatus includes a fluid passage for communicating fluid from a central flow passage of the casing into the air chamber. The fluid communicated into the air chamber through the fluid passage will move the sliding sleeve from the first to the second position in the casing.

In one embodiment the fluid passage comprises an annular space defined by an upper portion of the sliding sleeve and the casing. In an additional embodiment the flow passage comprises a port through a wall of the sliding sleeve. The first flow barrier is mounted in a groove, and in the second position the sliding sleeve covers the groove.

A method of placing a casing in a wellbore comprises in one embodiment creating a buoyancy chamber in the casing and lowering the casing into the wellbore. The method includes shattering an upper barrier of the buoyancy chamber into a plurality of fragments, and displacing the plurality of fragments downwardly in the casing. In one embodiment the shattering step comprises impacting the upper barrier with a sliding hammer sleeve in the casing. The sliding hammer sleeve may be releasably connected to the casing prior to the lowering step, and moving the hammer sleeve from a first to a second position in the wellbore. The hammer sleeve impacts the upper barrier prior to reaching the second position.

The moving step in one embodiment may comprise increasing the fluid pressure in the casing above the upper barrier to release the hammer sleeve from the casing. The method may thus comprise connecting a hammer sleeve in the casing above the upper barrier, detaching the hammer sleeve after the casing has been lowered into the well and impacting the upper barrier with the hammer sleeve. The detaching step may include increasing the hydraulic pressure in the casing above the hammer sleeve to a predetermined pressure required to detach the hammer sleeve.

Thus, it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of parts and steps may be made by those skilled in the art, which changes are encompassed within the scope and spirit of the present invention.

What is claimed is:

1. A downhole apparatus comprising:

a casing;

a frangible disk positioned in the casing;

a flow barrier connected in the casing string and spaced downwardly from the frangible disk, wherein the frangible disk and flow barrier define a buoyancy chamber;

a sliding sleeve terminating in a sharp end spaced from the frangible disk and movable from a first to a second position in the casing, wherein the sharp end impacts and shatters the frangible disk into a plurality of pieces that will pass downwardly in the casing, and wherein the frangible disk is mounted in a groove having upper and lower ends defined in the casing, and the sliding sleeve extends below and completely covers the groove in the second position.

2. The apparatus of claim 1, wherein the sliding sleeve impacts and shatters the frangible disk prior to reaching the second position.

3. The apparatus of claim 1, the sliding sleeve and an inner surface of the casing string defining an air chamber therebetween, further comprising a piston ring extending radially outwardly from an outer surface of the sliding sleeve into the air chamber and sealingly engaging the inner surface of the casing.

4. The apparatus of claim 3, further comprising a fluid passage communicated with the air chamber defined between the sliding sleeve and the casing, wherein fluid passing through the fluid passage will move the piston ring and the sliding sleeve into the second position.

5. The apparatus of claim 3, further comprising a rupture disk positioned in a port in a wall of the sliding sleeve, where the port communicates fluid to the air chamber to move the sliding sleeve to the second position when a burst pressure is applied to the rupture disk.

6. A downhole apparatus comprising:

a casing string;

a first flow barrier disposed in a groove having upper and lower ends in the casing string;

a second flow barrier positioned in the casing string and spaced from the first flow barrier, the first and second spaced-apart flow barriers defining a buoyancy chamber in the casing string;

a sliding sleeve having upper and lower ends disposed in the casing string, the lower end comprising a slanted lower end terminating in a sharp end, the sliding sleeve movable from a first to a second position in the casing, wherein the sliding sleeve extends below the lower end of the groove and completely covers the groove in the second position of the sliding sleeve; and the first flow barrier comprising a frangible disk that blocks flow through the casing, wherein the sharp end of the sliding sleeve engages and shatters the frangible disk into a plurality of fragments when the sliding sleeve moves from the first to the second position.

7. The downhole apparatus of claim 6 further comprising a rupture disk positioned in a port in a wall of the sliding sleeve, the sliding sleeve and the casing defining an annular air chamber therebetween, wherein the port communicates fluid from a central flow passage of the casing into the annular air chamber when the rupture disk ruptures and wherein the fluid moves the sliding sleeve from the first to the second position.

8. The downhole apparatus of claim 7 further comprising a piston ring fixedly disposed about the sliding sleeve, wherein fluid communicated through the port moves the piston ring in the air chamber.

9. The downhole apparatus of claim 6, further comprising, a connector releasably connecting the sliding sleeve to the casing string;

a piston ring connected to and extending radially outwardly from the sliding sleeve into an air chamber defined by the sliding sleeve and the casing; and a fluid passage for communicating fluid from a central flow path of the casing into the air chamber, wherein fluid communicated into the air chamber through the fluid passage will move the sliding sleeve from the first to the second position in the casing.

10. The downhole apparatus of claim 9, the fluid passage comprising an annular space defined by the sliding sleeve and the casing.

11. A method of placing casing in a wellbore comprising:

creating a buoyancy chamber having an upper barrier in the casing, the upper barrier comprising a disk disposed in a groove defined in the casing, the groove having upper and lower ends;

lowering the casing into the wellbore;

shattering the disk into a plurality of fragments;

completely covering the groove with a sleeve disposed in the casing; and displacing the plurality of fragments downwardly in the casing.

12. The method of claim 11, the sleeve comprising a sliding hammer sleeve, the shattering step comprising impacting the disk with the sliding hammer sleeve in the casing.

13. The method of claim 12 further comprising:

releasably connecting the sliding hammer sleeve to the casing prior to the lowering step; and moving the sliding hammer sleeve from a first to a second position in the wellbore, wherein the sliding hammer sleeve impacts the disk prior to reaching the second position, and completely covers the groove in the second position.

14. The method of claim 13, the moving step comprising increasing the hydraulic pressure in the casing above the disk to release the sliding hammer sleeve from the casing.

15. The method of claim 12 further comprising:

connecting the sliding hammer sleeve in the casing above the disk;

detaching the sliding hammer sleeve after the casing has been lowered into the well; and impacting the disk with the sliding hammer sleeve.

16. The method of claim 15, the detaching step comprising increasing the pressure in the casing above the sliding hammer sleeve to a predetermined pressure required to detach the sliding hammer sleeve.

17. The method of claim 15 further comprising displacing well tools into the casing through a bore of the sliding hammer sleeve.

* * * * *